United States Patent [19]

Deitch

[11] 3,993,389

[45] Nov. 23, 1976

[54] PATCH CORD

[75] Inventor: James C. Deitch, Bloomington, Minn.

[73] Assignee: Magnetic Controls Company, Minneapolis, Minn.

[22] Filed: Sept. 15, 1975

[21] Appl. No.: 613,432

[52] U.S. Cl. ..... 339/91 R; 339/183

[51] Int. Cl.[2] ..... H01R 17/18

[58] Field of Search ..... 339/18 P, 47 R, 47 C, 339/91 R, 91 P, 76, 182, 183, 217 J; 179/97, 91 A, 96

[56] References Cited

UNITED STATES PATENTS

| | | | |
|---|---|---|---|
| 762,684 | 6/1904 | Case | 339/91 R X |
| 3,284,755 | 11/1966 | Mummey et al. | 339/217 J X |
| 3,358,262 | 12/1967 | Schumacher | 339/91 P X |

*Primary Examiner*—Roy Lake
*Assistant Examiner*—E. F. Desmond
*Attorney, Agent, or Firm*—Neil B. Schulte

[57] ABSTRACT

An intermediate patch cord for connecting together two other patch cords including a connecting wire with a standard plug receiving jack at each end. The plug receiving jack is formed from a pair of identical plastic molded housings and incorporates a pair of springable plug grasping fingers extending from one end to hold a standard plug in the jack housing.

5 Claims, 6 Drawing Figures

FIG. 1
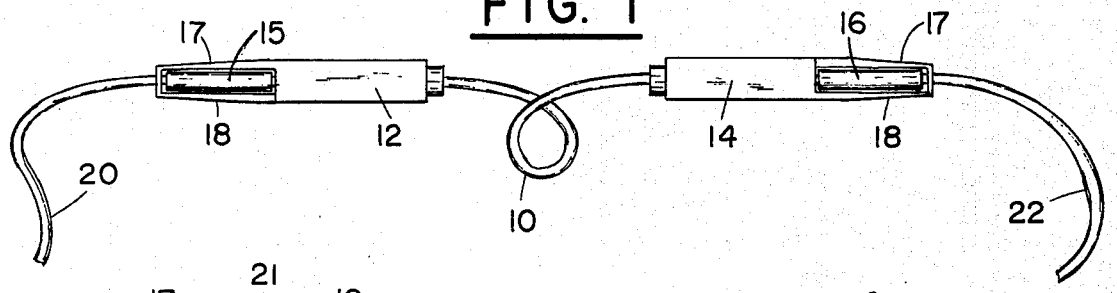
FIG. 6
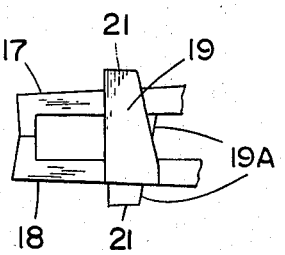
FIG. 2
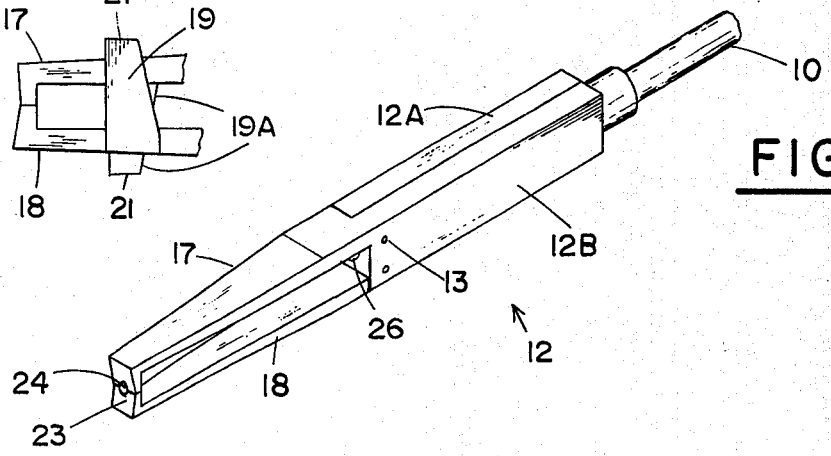
FIG. 3
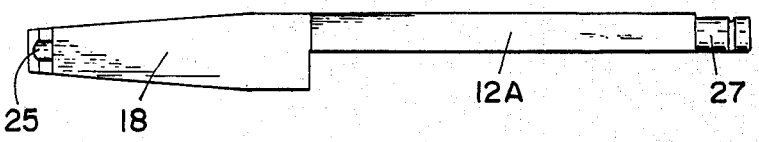
FIG. 4
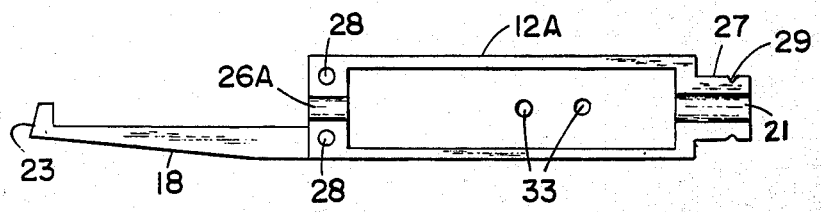
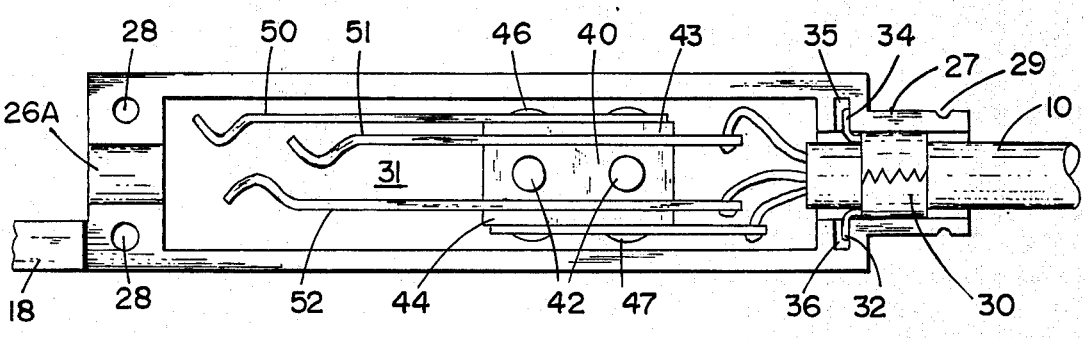
FIG. 5

PATCH CORD

BACKGROUND OF THE INVENTION

This invention relates to the field of electrical communication and especially to the telephone arts wherein numerous connections are made by means of patch cords in order to test circuits, complete communication paths, or otherwise temporarily attach one piece of equipment to another piece of equipment. As the prior art relative to patch cords has expanded different kinds of connectors have come into use until the assortment has proliferated to include a very large number of different connectors such as two conductor plugs, three conductor plugs, alligator clips, banana plugs, tip plugs, miniature plugs of the two and three conductor variety, bayonet nut coupling plugs, concentrated connection bay plugs, and many others too numerous to list here. Whenever it becomes necessary to connect a circuit utilizing one type of connector to another circuit utilizing a different connector a particular patch cord having those two distinct connectors on opposite ends is required. Thus, as the number of connector types increases the variety of patch cords increases much faster. If the number of connectors is described by N the number of patch cords required is described by N!. The present invention strives to avoid this complexetity as described hereinafter.

SUMMARY OF THE INVENTION

Briefly, my invention contemplates the use of an intermediate patch cord which would bridge from a patch cord having one type of connector on one end and a standard plug on the other end to a second patch cord having a different type of connector on one end and a standard plug on the other end. Accordingly for N different types of connectors it is only necessary to have N different types of patch cords all terminating in standard plugs which then are tied together by the intermediate patch cord of the present invention. Clearly the complexity and expense involved in making temporary connections is greatly reduced thereby. To insure that all of these patch cords stay securely fastened together the intermediate cord of the present invention is provided with jacks on each end which not only accept a standard plug but grasp it and hold it in place by means of springable fingers molded thereon. In addition, the jack itself is formed from two halves which are molded identically therefore further allowing a reduction in cost. It therefore may be seen that it is an object of my invention to provide an improved patch cord arrangement of much less expense and complexity by providing an intermediate or transition patch cord which allows the coupling together of any number of different connectors conveniently and quickly. Further objects and advantages will become apparent from the following detailed description and drawings.

BRIEF DESCRIPTION OF THE DRAWINGS

FIG. 1 is a schematic drawing showing the intermediate patch cord of the present invention connecting together two conventional patch cords.

FIG. 2 is a perspective view of the jack used in the present intermediate patch cord invention.

FIGS. 3 and 4 show respectively top and side views of one half of the jack housing which can be assembled with a second identical half to form a complete jack housing as shown in FIG. 2.

FIG. 5 is an enlarged detail view of the jack housing opened to show one possible arrangement of electrical contacts therein.

FIG. 6 shows a possible modification of the grasping fingers to allow easy spreading thereof for insertion and withdrawal of a standard plug.

DESCRIPTION OF THE PREFERRED EMBODIMENT

Referring to FIG. 1 the intermediate patch cord of the present invention is shown. A connecting cable or cord 10 extends from one standard plug receiving jack 12 to another plug receiving jack 14. Both jacks are identical and each has a pair of springable grasping fingers 17 and 18 extending from one end which spring together behind a standard plug 15 or 16. The standard plug used may be any plug desired but in the preferred embodiment it is contemplated that a conventional telephone plug may be utilized. Standard plug 15 is mounted on the end of a first patch cord 20 which may have any type of desired connector on the other end. Standard plug 16 is connected to a second patch cord 22 which, although not shown in the drawing, is connected to another type of needed connector to complete the desired connection. Accordingly, it is only necessary to have patch cords comprising standard plugs on one end and the desired connector on the other. To go from one connector to a different connector the two suitable patch cords are selected and plugged in as shown in FIG. 1 to the intermediate patch cord 10. Grasping fingers 17 and 18 comprise standard plug retaining means which insure that the standard plugs 15 and 16 will not withdraw from jacks 12 and 14 accidentally.

In FIG. 2 jack 12 is shown in perspective to indicate that the housing therefor is constructed form two identical molded plastic halves 12A and 12B. These two halves may be rotated and screwed together by means of a pair of screws 13 to form a complete jack 12. The flexible plastic extension on the end of one half will form one grasping finger 17 while the identical extension on the half 12A forms finger 18. Fingers 17 and 18 have indentations 25 formed in the right angle portion 23 at the end so that in conjunction they form a hole 24 through which the cord portion of the selected patch cord fits. Standard plug 15 or 16 is trapped between the fingers 17 and 18 with the connecting end thereof in a hole 26 in the housing formed by indentations 26A in the plastic halves. Each half of the housing may be better seen with reference to the top and side views shown in FIGS. 3 and 4.

In FIGS. 3 and 4 it may be seen that each half of the housing, in this case half 12A, is formed with a recessed area 31 which forms the interior chamber of the plug when assembled. Holes 28 are provided transverse to the entrance hole 26 to permit the insertion therethrough of screws 13. A half round area 26A is molded in one end to form a hole 26 to accept the standard plug while a half round area 21 is formed in the other end to form a complete hole to accept cord 10. Grasping finger 18 is formed by the extension molded to the half housing which is by its nature fairly springable so that it can be separated sufficiently from grasping finger 17 to allow the insertion of a standard plug. A small annular groove 29 is formed in the half round section 27 so that when the housing is assembled it may be held together not only by the screws 13 but by a small metal ring inserted in groove 29. A pair of circular indentations 33 provide for the mounting of the metal electrically conductive springs inside the housing as shown in FIG. 5.

In FIG. 5 it may be seen that a number of spring metal contacts 50, 51 and 52 are mounted on a plastic block 40 by means of electrical insulators 43 and 44 and a pair of rivets 46 and 47. Rivets 46 and 47 pass through the plastic block in a manner well known to those skilled in the art and are not further described here. The plastic block 40 itself has a pair of cylindrical risers 42 on each side which drop into the recesses 33 in the halves of the housing so as to hold block 40 in the position shown inside housing or jack 12.

Cord 10 is secured through opening 21 by means of a small metal clip 30 which is compressed about the cord 10. Clip 30 includes a pair of tabs 32 and 34 which rest in slots 35 and 36 in the plastic housing. The wires in cord 10 are then connected to spring contacts 50, 51 and 52 which contacts make resilient connections with an inserted plug in a manner well known to those skilled in the art and serve both to retain the plug and complete the circuits.

The springs shown here are a preferred embodiment only and other techniques may be employed to effect a connection with the standard plug.

Turning to FIG. 6, a variation on the present invention is shown wherein each of the grasping fingers is provided with small projections which extend toward and past each other so that the grasping fingers may be easily separated to permit the insertion and withdrawal of the standard plug. Grasping finger 18 is provided with a projection 19 while finger 17 is provided with a projection 19A. By using the thumb and forefinger to press the opposed surfaces 21, the two fingers 17 and 18 can be easily separated. Again other mechanical configurations could be utilized to effect this separation and the embodiment shown is only one possible way of accomplishing this end. Thus, I do not intend to be limited to the invention exactly as shown except as defined by the appended claims.

I claim:

1. An intermediate patch cord connector for connecting together a first patch cord which has a standard plug on one end and a first needed connector on the other end and a second patch cord which has a standard plug on one end and a second needed connector on the other end, said intermediate patch cord comprising a cord electrically connecting together a pair of standard plug receiving jacks, said jacks including plug retaining means and in which said jacks each comprise a housing adapted to contain electrical contact springs therein connected at one end to said cord and positioned to make resilient contact with a standard plug inserted through a hole in said housing.

2. The apparatus of claim 1 in which said retaining means further comprise springable plug grasping fingers extending from said housing so as to hold a plug in the hole in said housing.

3. The apparatus of claim 2 in which said housing is formed from a pair of identical molded plastic halves each of which is formed to include one of said fingers extending therefrom.

4. The apparatus of claim 3 in which said contact springs are mounted on a block held in position between the two housing halves.

5. The apparatus of claim 4 including projections near the grasping ends of said fingers which extend toward and past each other so as to provide a means for conveniently spreading the fingers to allow a plug to be inserted therebetween.

* * * * *